United States Patent [19]

Israel

[11] 4,173,449

[45] Nov. 6, 1979

[54] SURFACTANT SYSTEM FOR FUEL CATALYZER

[76] Inventor: Seymour Israel, 40-06 45 St. (4F), New York, N.Y. 11104

[21] Appl. No.: 886,762

[22] Filed: Mar. 15, 1978

Related U.S. Application Data

[63] Continuation of Ser. No. 678,532, Apr. 20, 1976, abandoned.

[51] Int. Cl.[2] ..... F23J 7/00

[52] U.S. Cl. ..... 431/4; 123/25 R; 261/18 B; 431/190

[58] Field of Search ..... 431/4, 190; 261/18 A, 261/18 B; 123/25 R

[56] References Cited

U.S. PATENT DOCUMENTS

| | | | |
|---|---|---|---|
| 3,862,819 | 1/1975 | Wentworth, Jr. | 431/4 |
| 4,009,984 | 3/1977 | Morrison | 431/4 |
| 4,014,637 | 3/1977 | Schena | 431/4 |

*Primary Examiner*—Edward G. Favors

*Attorney, Agent, or Firm*—Hubbell, Cohen, Stiefel & Gross

[57] ABSTRACT

An apparatus and method are disclosed for adding finely dispersed water and water vapor to the air intake stream of a fuel-air combustion system. A solution of bubble-enhancing surfactant in water partly fills a container. A jet of air bubbles is blown into the solution below its free surface so that a quantity of aqueous bubbles forms on the free surface. A part of the air intake stream is then drawn from this quantity of aqueous bubbles.

19 Claims, 5 Drawing Figures

SURFACTANT SYSTEM FOR FUEL CATALYZER

This is a continuation of application Ser. No. 678,532, filed Apr. 20, 1976 now abandoned.

BACKGROUND OF THE INVENTION

1. Field of the Invention

This invention relates to combustion of fuels and, in particular, more complete combustion assisted by the addition of water vapor.

2. Prior Art

Man first observed combustion in pre-history and has tried to control and improve combustion for several thousand years. It has long been known that the presence of a vapor, such as that of water, enhances the combustion process. There are some disagreements over the reasons for, and the extent of the improvement.

It has been described as a catalyst. It has been explained as a cooling effect to reduce precombustion and detonation. Further, it has been suggested that the water vapor releases hydrogen to combine with the carbon in the fuel and that the liberated oxygen also combines with the carbon.

It has also been suggested that the improvements are in more complete combustion, more efficient use of fuel, reduction of pollutants, and possibly increased heat output.

Systems for adding water vapor have been known as steam injection and have also been disclosed by WENTWORTH in U.S. Pat. No. 3,862,819 and by ZINK in U.S. Pat. No. 3,814,567.

Wentworth proposes an oil film on top of water in generating adequate vapor. Zink is concerned primarily in reducing the size of water bubbles as a step towards creating adequate vapor. Zink's system may be too expensive for the typical small homeowner.

SUMMARY

It is therefore an object of this invention to overcome the limitations and disadvantages in the fuel catalyzer system in the prior art and currently available in the market.

One of the objects of the invention is to provide a fuel catalyzer system embodying improved principles of design and construction.

An important object of the invention is to provide a fuel catalyzer system which is comprised of a number of durable parts and components which can be economically manufactured and readily assembled.

A significant object of the invention is to provide a fuel catalyzer system, so designed and constructed that it can be readily installed to almost any typical fossil fuel combustion system now in use.

Another object of the invention is to provide a fuel catalyzer system for improving combustion efficiency.

A further object of the invention is to provide an improved system for producing water vapor for assisting combustion.

Yet another object of the invention is to provide a means for producing water vapor from a quantity of large easy-to-burst bubbles.

A method and apparatus for adding finely dispersed liquid water and water vapor to combustion air in a fuel-air-combustion system having a means for forced intake of a stream of combustion air; the method including generating a quantity of aqueous bubbles from a solution of bubble-enhancing surfactant in water, the solution having a lower surface tension than water, and entraining the aqueous bubbles at a controlled rate into the combustion air stream; and the apparatus including a closed container having a wall for holding a body of solution of bubble-enhancing surfactant in water, the solution having a lower surface tension than water, and the body having a free surface, a means for adding water, and the body having a free surface, a means for adding the solution so that the free surface remains at a substantially fixed level, a conduit through the wall of the container having an inlet located in the atmosphere and an outlet located at a point in the solution body beneath the free surface for passing atmospheric air from the inlet to the outlet, a tube through the wall of the container having first and second open ends, the first open end being located at a point above the free surface within the container and the second open end being joined in fluid conduction relation to the means for forced intake of combustion air, and means for controlling the portion of the forced intake stream of combustion air which is drawn from the tube so that a jet of air bubbles passing through the solution body and rising to the free surface will form a quantity of aqueous bubbles above the free surface which will be drawn into the combustion air stream.

Further objects and advantages of this invention will appear more clearly from the following description of non-limiting illustrative embodiments and the accompanying drawings in which like numerals designate like parts thruout the several views.

DESCRIPTION OF DRAWINGS

Briefly summarized, a preferred embodiment of the invention is described in conjunction with an illustrative disclosure thereof in the accompanying drawings, in which.

DESCRIPTION OF TYPICAL EMBODIMENTS

Figure 1:
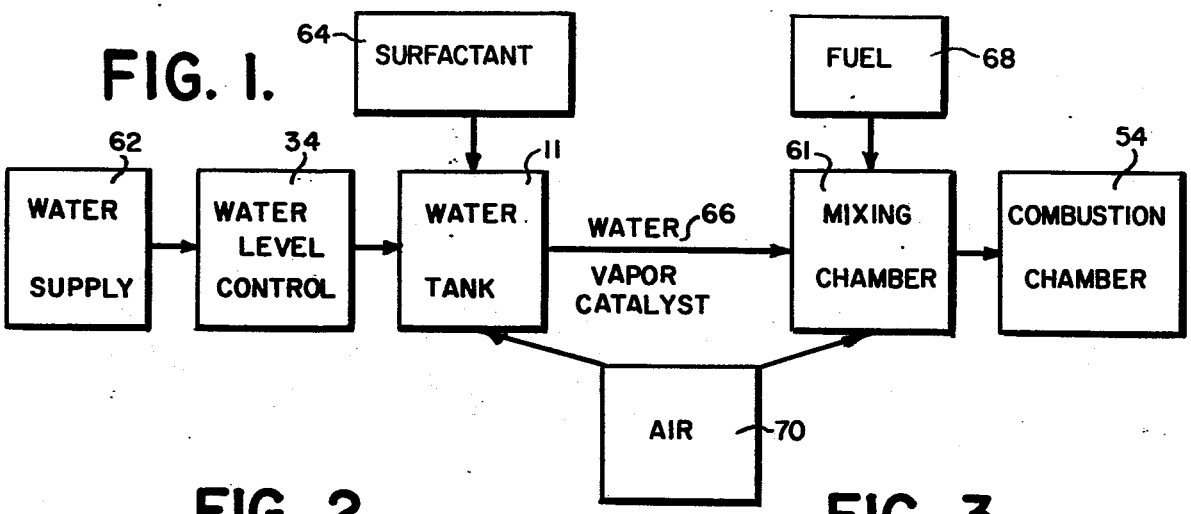
FIG. 1 is a block diagram representation of the system according to the principles of this invention.
Figure 2:
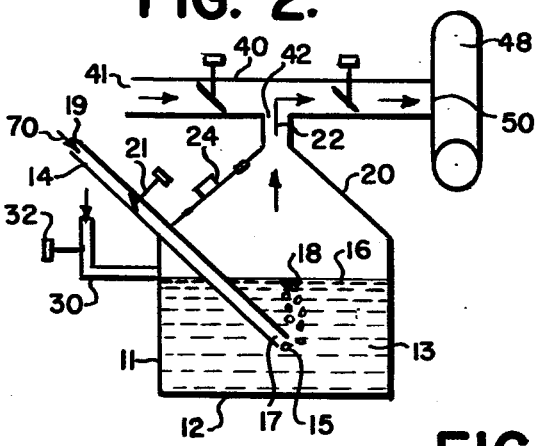
FIG. 2 is an outline drawing of a container for liquids providing water vapor to the intake of the blower.
Figure 3:
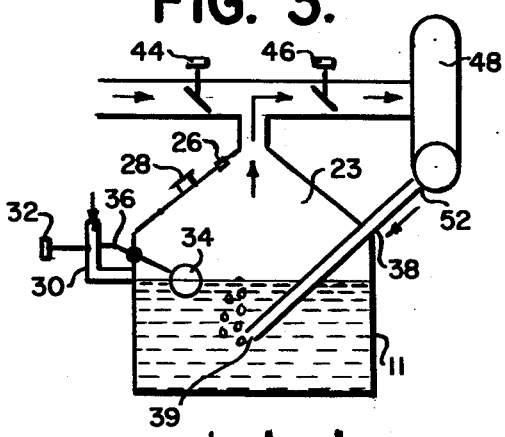
FIG. 3 is an outline drawing similar to FIG. 2 in which the blower provides air under pressure for bubbling thru the liquid.
Figure 4:
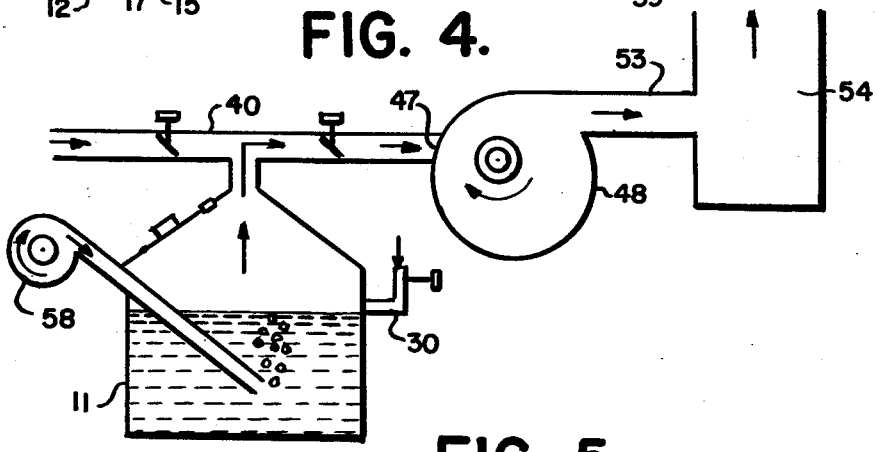
FIG. 4 is an outline drawing of a similar system with another blower providing the air for bubbling and the water vapor entering the periphery of the volute casing of the first blower.
Figure 5:
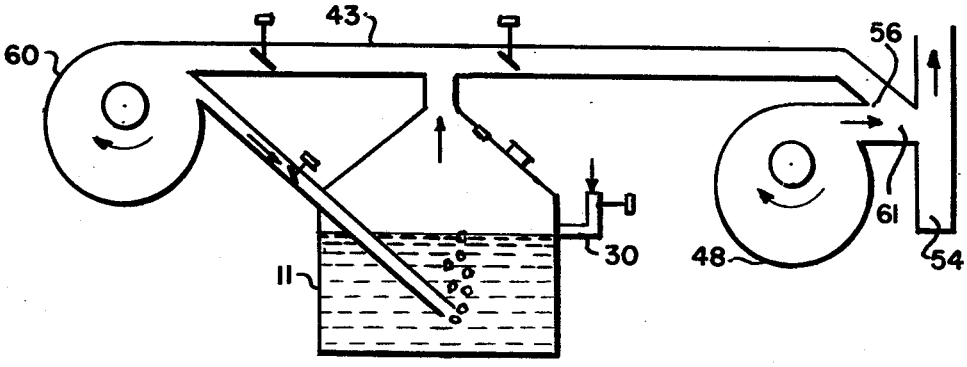
FIG. 5 is an outline drawing of a similar system in which the water vapor enters the fuel mixing chamber after the blower.

In the drawings a surfactant system for a fuel catalyzer embodying features of the invention is illustrated for facilitating the addition of water vapor to a fossil fuel mixture for burning in a combustion chamber 54 having a forced air intake by means of a blower 48 generally used as a blower gun.

The water vapor 66 which serves to enhance the combustion process is obtained by supplying water from a supply 62 via piping 30, provided with flow control means which may be a valve 32, to a container 11 for liquids 13 into which a gas such as air 70 is injected via pipe 14, provided with flow control means which may be a valve 21 such as a damper, immersed below the surface 16 of the liquid. The gas such as air 70 exits end 17 of pipe 14 and forms bubbles 15 which rise to the free surface 16 of the liquid 13 as shown by bubble 18 soon to be liberated from the mass of the liquid and to float into the gaseous vapor region 23 in the upper part of the container 11 towards its exit 22 connected 42 to pipe 40 thru which the vapor mixed with air is drawn by blower 48 or forced by blower 60.

The upper part 20 of the container 11 may be formed to more efficiently direct vapor flow towards exit 22 and may be provided with a closeable 28 opening 24 for access to the container including the operation of adding surfactant 64 in liquid or solid form such as powder or tablets.

Surfactant 64 may be in a gaseous state and may alternatively be added to entering gas via pipe 14. The desired surface active agent 64 may be any known agent such as an aerosol and must reduce surface tension of the liquid, which therefore contributes to more rapid and easier production of bubbles and vapor and to the instability of bubbles which burst more easily.

The liquid 13 level 16 in the container 11 may be maintained by additions via pipe 30 controlled manually by valve 32 or automatically by valve 36 which may be actuated by a float 34.

Air 70 may be added to the liquid 13 to form bubbles via pipe 14 from free end 19 by the action of suction due to blower 48 or by positive pressure by blower 58 or 60 or by positive pressure via pipe 38 connected 52 to a suitable point on the volute casing of blower 48.

Primary air 70 is drawn to the combustion process via pipe 40 from free end 41, controlled by valves 44, 46 generally dampers, to the intake 50 of blower gun 48 which is usually of a centrifugal type, the outlet 53 of which is usually connected directly to the air 70 fuel 68 mixing chamber 61 and into the combustion chamber 54.

Alternatively, positive pressure supplied by blower 60 may be employed in either or both pipes 14, 43 to blow bubbles into the liquid 13 or to entrain the vapor in air flow in pipe 43 directly to the air fuel mixing chamber 61 at 56.

Although there is considerable debate about the precise effect of water vapor, bubbles, and the size of the bubbles upon the combustion process, it does appear that the net effect is beneficial.

The system described here can be readily applied even to the small heating plant in the average home.

The system can be assembled or manufactured from available components and known materials by known methods.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

What is claimed is:

1. A method of adding finely dispersed liquid water and water vapor to combustion air in a fuel-air combustion system which includes a means for forced intake of a stream of said combustion air, said method comprising:

(a) generating a quantity of aqueous bubbles from a solution of bubble-enhancing surfactant in water, said solution having a lower surface tension than water; and (b) entraining said aqueous bubbles at a controlled rate into said combustion air stream.

2. The method of claim 1, wherein said step of generating said aqueous bubbles is performed with a body of said solution having a free surface, and wherein said generating step comprises blowing air into said solution body beneath said free surface so that bubbles will rise to said free surface to form a quantity of aqueous bubbles upon passing therefrom.

3. The method claim 1 in which said step of entraining said aqueous bubbles comprises drawing a controlled portion of said forced intake stream of combustion air from said quantity of aqueous bubbles.

4. In combination with a fuel-air combustion system which includes a means for causing a forced intake of a stream of combustion air, apparatus for adding finely dispersed liquid water and water vapor to said stream of combustion air, said apparatus comprising:

(a) means for generating a quantity of aqueous bubbles from a solution of bubble-enhancing surfactant in water, said solution having a lower surface tension than water; and (b) means for entraining said aqueous bubbles at a controlled rate into said combustion air stream.

5. The apparatus of claim 4, in which said means for generating a quantity of aqueous bubbles comprises:

(a) a container for holding a body of said solution of bubble-enhancing surfactant in water, said body having a free surface;

(b) a conduit, having an inlet located in the atmosphere and an outlet located at a point in said solution body beneath said free surface, for passing atmospheric air from said inlet to said outlet; and (c) means for blowing said atmospheric air from said inlet through said conduit out said outlet to form a jet of air bubbles in said solution body whereby said bubbles will rise to said free surface and will form a quantity of aqueous bubbles on said free surface.

6. The apparatus of claim 4 in which said means for entraining said aqueous bubbles comprises:

(a) a tube, having first and second open ends, said first open end abutting said quantity of aqueous bubbles, and said second open end being connected in fluid conduction relation to said means for forced intake of combustion air; and (b) a control valve in said tube between said first and second ends for controlling the ratio of the portion of said forced intake stream of combustion air from said quantity of aqueous bubbles to the entire combustion air intake stream.

7. An apparatus, used in combination with a fuel-air combustion system which includes a means for causing a forced intake of a stream of combustion air, said means also providing a stream of pressurized air, for adding finely dispersed liquid water and water vapor to said combustion air, said apparatus comprising:

(a) a closed container having a wall for holding a body of solution of bubble-enhancing surfactant in water, said solution having a lower surface tension than water, said body having a free surface;

(b) a means for adding said solution so that said free surface remains at a substantially fixed level;

(c) a conduit through the wall of said container having an inlet located in the atmosphere and an outlet located at a point in said solution body beneath said free surface for passing atmospheric air from said inlet to said outlet;

(d) a tube through the wall of said container having first and second open ends, said first open end being located at a point above said free surface within said container, and said second open end being joined in fluid conduction relation to said means for forced intake of combustion air; and (e) means for controlling the portion of said forced intake stream of combustion air, which is drawn from said tube; so that a jet of air bubbles passing into said body and rising to said free surface will form a quantity of aqueous bubbles above said free surface which will be drawn into said combustion air stream.

8. The apparatus of claim 7 wherein a part of said closed container wall is transparent.

9. The apparatus of claim 7 wherein said closed container has an opening in the wall thereof and said means for adding said liquid solution of surfactant in water comprises:

(a) a detachable closure for said container wall opening;

(b) a water supply line through said wall into said container;

(c) a water valve in said water supply line; and (d) means for indicating the level of said free surface; so that said bubble-enhancing surfactant may be added through said opening and additional water may be added by adjusting said water valve to thereby add said liquid solution to keep said free surface at a substantially fixed level as indicated by said means for indicating said level.

10. The apparatus of claim 9, including automatic control means for adjusting said water valve in response to indications from said means for indicating the level of said free surface.

11. The apparatus of claim 10, wherein said means for indicating said level, said automatic control means, and said water valve are combined in a float valve.

12. The apparatus of claim 7, in which said inlet of said conduit is joined to said means for causing a forced intake so as to receive a stream of pressurized air therefrom.

13. The apparatus of claim 7, further comprising an air pump attached to said conduit at said inlet for blowing atmospheric air into said inlet through said conduit out said outlet.

14. The apparatus of claim 13, in which a pipe runs from said air pump to said means for causing a forced intake of combustion air so that air is also blown directly to said means for causing a forced intake.

15. An apparatus, used in combination with a fuel-air combustion system which includes a forced-air blower which draws in a stream of combustion air through a duct attached to said blower, which duct has an intake opening located in the atmosphere, for adding finely dispersed liquid water and water vapor to said combustion air, said apparatus comprising:

(a) a closed container having a wall for holding a body of solution of bubble-enhancing surfactant in water, said solution having a lower surface tension than water, said body having a free surface;

(b) a means for adding said solution so that said free surface remains at a substantially fixed level;

(c) a conduit through the wall of said container having an inlet located in the atmosphere and an outlet located at a point in said solution body beneath said free surface for passing atmospheric air from said inlet to said outlet;

(d) a tube through the wall of said container having first and second open ends, said first open end being located at a point above said free surface within said container, and said second open end being joined in fluid conduction relation to said duct at a location between said blower attachment and said intake opening; and (e) means for controlling the portion, of said forced intake stream of combustion air, which is drawn from said tube; so that a jet of air bubbles passing into said solution body and rising to said free surface will form a quantity of aqueous bubbles above said free surface which will be drawn into said combustion air stream.

16. The apparatus of claim 15 wherein said means for controlling the portion of said forced intake stream of combustion air which is drawn from said tube comprises a control valve in said conduit between said inlet and said outlet.

17. The apparatus of claim 15 wherein said means for controlling the portion of said forced intake stream of combustion air which is drawn from said tube comprises a first damper in said duct between said intake opening and said location at which said tube is joined to said duct.

18. The apparatus of claim 17 wherein said means for controlling the portion of said forced intake stream of combustion air which is drawn from said tube additionally comprises a control valve in said conduit between said inlet and said outlet.

19. The apparatus of claim 18 wherein said means for controlling the portion of said forced intake stream of combustion air which is drawn from said tube additionally comprises a second damper in said duct between said blower attachment and said location at which said tube is joined to said duct.

* * * * *